US007100856B2

(12) United States Patent
Murphy, Jr.

(10) Patent No.: US 7,100,856 B2
(45) Date of Patent: Sep. 5, 2006

(54) THREAD SPOOL AND BOBBIN HOLDER

(76) Inventor: H. Stetser Murphy, Jr., 1525 G Terrell Mill Pl., Marietta, GA (US) 30067

( * ) Notice: Subject to any disclaimer, the term of this patent is extended or adjusted under 35 U.S.C. 154(b) by 0 days.

(21) Appl. No.: 10/776,847

(22) Filed: Feb. 11, 2004

(65) Prior Publication Data

US 2005/0173586 A1 Aug. 11, 2005

(51) Int. Cl.
*B65H 75/02* (2006.01)

(52) U.S. Cl. ..... 242/118.41

(58) Field of Classification Search ..... 242/588, 242/134, 132, 137, 146, 118.4, 118.41
See application file for complete search history.

(56) References Cited

U.S. PATENT DOCUMENTS

| | | | | | |
|---|---|---|---|---|---|
| 897,822 | A | * | 9/1908 | Dougherty | 242/137.1 |
| 1,558,561 | A | * | 10/1925 | Mossberg | 242/129.7 |
| 2,056,072 | A | * | 9/1936 | Noschang | 200/535 |
| 2,428,898 | A | * | 10/1947 | Waymouth | 361/284 |
| 2,914,271 | A | * | 11/1959 | Staufert | 242/130.2 |
| 3,284,025 | A | * | 11/1966 | Fridolph | 242/137 |
| 3,854,673 | A | * | 12/1974 | Manning | 242/118.41 |
| 4,088,380 | A | | 5/1978 | Watts | |
| 4,106,676 | A | | 8/1978 | Freerking | |
| 4,155,519 | A | * | 5/1979 | Price | 242/118.41 |
| 4,195,739 | A | | 4/1980 | Sweet, III | |
| 4,351,458 | A | | 9/1982 | Wolfe | |
| 4,407,461 | A | | 10/1983 | Tomisawa | |
| 4,648,338 | A | | 3/1987 | Rusconi et al. | |
| 4,666,096 | A | | 5/1987 | Heel et al. | |
| 4,824,041 | A | * | 4/1989 | Myers | 242/118.41 |
| 4,998,685 | A | * | 3/1991 | Spencer | 242/137 |
| 5,188,046 | A | | 2/1993 | Badillo | |
| 5,211,353 | A | * | 5/1993 | Lewin et al. | 242/118.41 |
| 5,913,485 | A | | 6/1999 | Bruffett | |
| 6,036,136 | A | | 3/2000 | Bobo | |
| 6,044,782 | A | | 4/2000 | Fressemann et al. | |
| 6,098,911 | A | | 8/2000 | Sheldon | |
| 6,152,057 | A | | 11/2000 | Badillo | |
| 6,540,075 | B1 | | 4/2003 | King | |
| 2003/0010662 | A1 | | 1/2003 | King | |

* cited by examiner

*Primary Examiner*—Kathy Matecki
*Assistant Examiner*—Evan Langdon
(74) *Attorney, Agent, or Firm*—Myers & Kaplan LLC; Joel D. Myers, Esq.

(57) ABSTRACT

The invention is a combination spool and bobbin holder having essentially separate sections for the spool and the bobbin. The color of the thread is visible on both the spool and the bobbin for selection purposes and to ensure that the correct bobbin is stored with the correct spool. The device has retention devices to secure the spool and/or bobbin, and/or receiving devices to facilitate insertion of the spool and bobbin within, or to, the device.

25 Claims, 8 Drawing Sheets

THREAD SPOOL AND BOBBIN HOLDER

TECHNICAL FIELD

The present invention relates generally to an apparatus and method for storing a spool of thread together with a bobbin wound with the same color thread.

BACKGROUND OF THE INVENTION

Although various devices and methods for holding and storing spools and bobbins are known, all are disadvantageous when compared to the present invention. For instance, some devices contain the bobbin within a cavity in the spool, which prevents observation of the bobbin thread color and requires modification of the spool. Other devices require protuberances to be formed onto the spool itself in order to hold the bobbin thereon. Inclusion of these modifications increases manufacturing costs and the resulting devices have limited versatility. Since spools of thread are in the nature of commodities and costs must be controlled, the inclusion of additional and/or costly features thereon can be disadvantageous.

While the known devices may be utilized for storing spools of thread with their associated bobbins, they have limited function and appeal for their intended use. Therefore, it is readily apparent that there is a need for a spool/bobbin apparatus and method that overcomes the aforementioned disadvantages by providing secure containment of the bobbin and the spool with their thread colors still visible.

BRIEF SUMMARY OF THE INVENTION

The present invention began out of a need for a device to keep bobbins together with the spool of thread wherefrom the bobbins were wound, whereby the thread color on both the spool and the bobbin remain visible to the user.

The present invention, in a preferred embodiment, overcomes the afore-mentioned disadvantages and meets the recognized need for a device by keeping the bobbin together with the spool of thread from which the bobbin was wound, whereby the thread color on both the spool and bobbin remain visible to the user.

According to its major aspects and broadly stated, the present invention in its preferred embodiment is a holder having a first section for retaining a spool of thread and a second section for retaining the associated bobbin.

More specifically, the present invention in its preferred embodiment is a formed plastic containment device with a first section which inserts into and holds a spool of thread thereon and a second section which receives and holds a bobbin inserted therein.

A feature and advantage of the present invention is that the thread color remains visible on both the spool and its associated bobbin.

A feature and advantage of the present invention is that it keeps a spool and its associated bobbin securely together.

A feature and advantage of the present invention is its ease of use.

A further feature and advantage of the present invention is its ease of manufacture and low cost of production.

A further feature and advantage of the present invention is its convenient size.

A feature and advantage of the present invention is its separate retainers for the spool and bobbin.

An additional feature and advantage of the present invention is its suitability for being molded as a unit.

A feature and advantage of the present invention is that it may be formed in separate parts and subsequently assembled.

Another feature and advantage of the present invention is that it prevents thread from unwinding from the spool and/or bobbin when each is retained by the present device.

An additional feature and advantage of the present invention is its ability to utilize the formed shape of the edges of a traditional thread spool to assist in retention of the spool within the confines of the present invention.

These and other features and advantages of the present invention will become more apparent to one skilled in the art from the following description and claims when read in light of the accompanying drawings.

BRIEF DESCRIPTION OF THE DRAWINGS

Figure 1A:
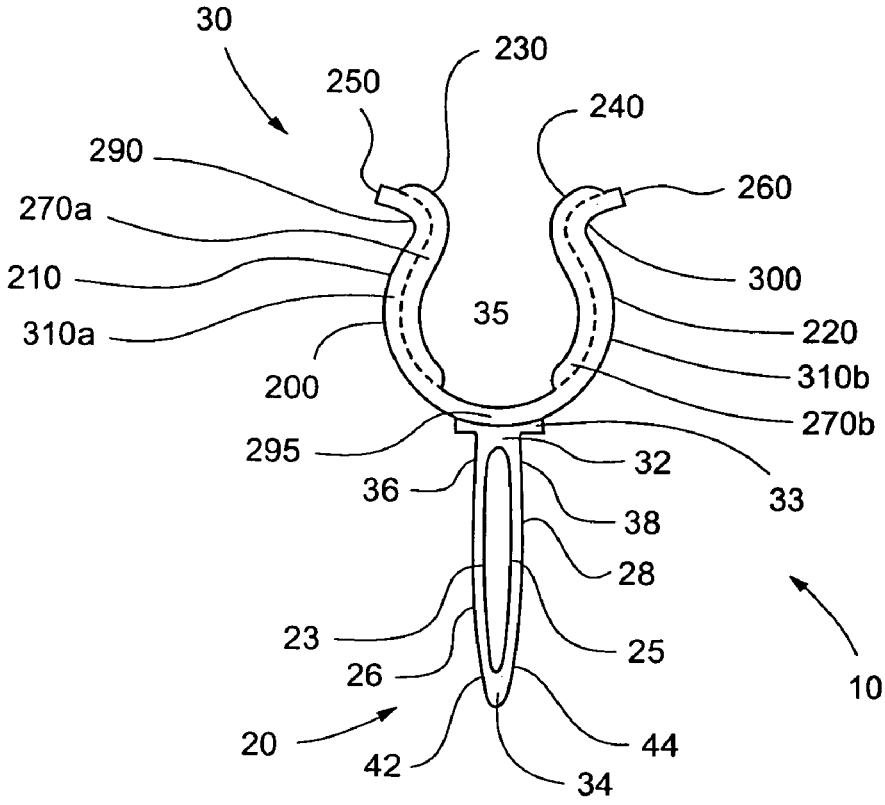
Figure 1B:
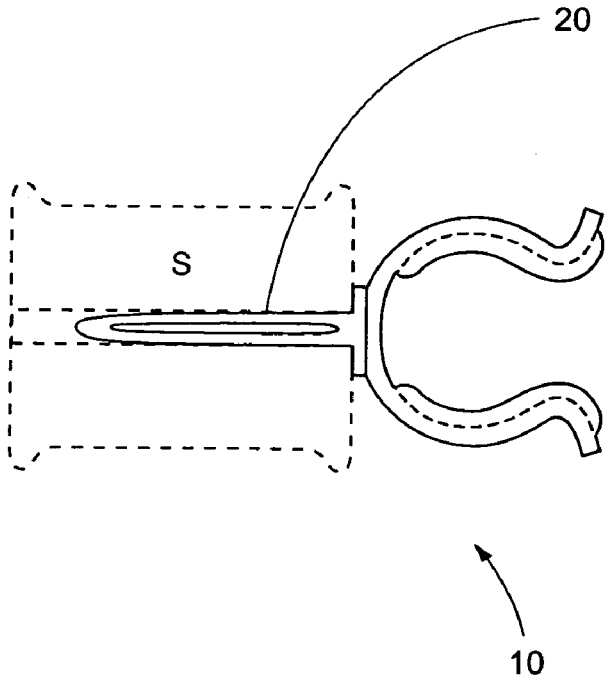

Having thus described the invention in general terms, the present invention will be better understood by reading the Detailed Description of the Preferred and Selected Alternate Embodiments with reference to the accompanying drawing figures, which are not necessarily drawn to scale, and in which like reference numerals denote similar structures and refer to like elements throughout, and in which:

FIG. 1A is a plan view of a device according to a preferred embodiment of the present invention;

FIG. 1B is depicts the device of FIG. 1A in use, inserted within a spool.

Figure 2:
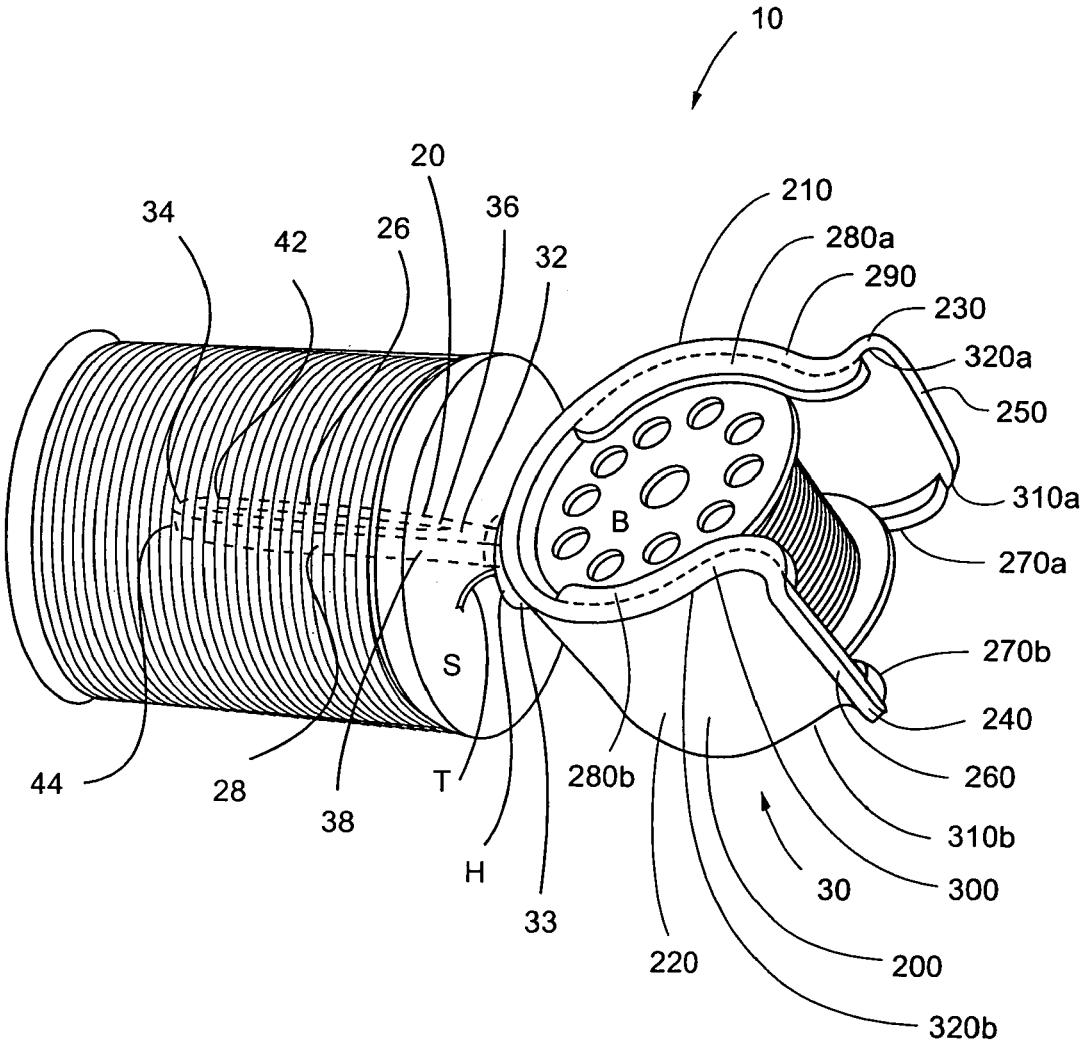
Figure 3:
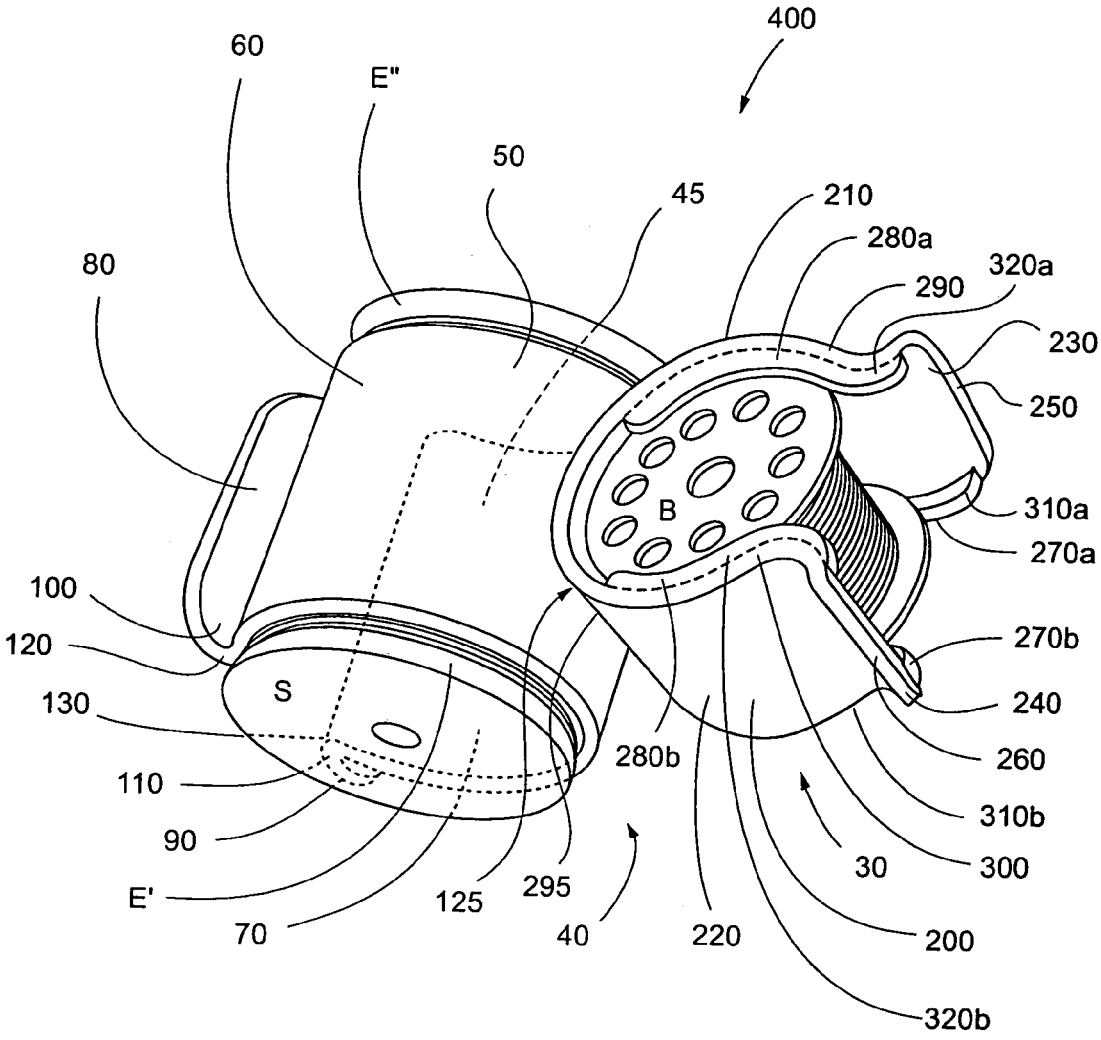
Figure 4:
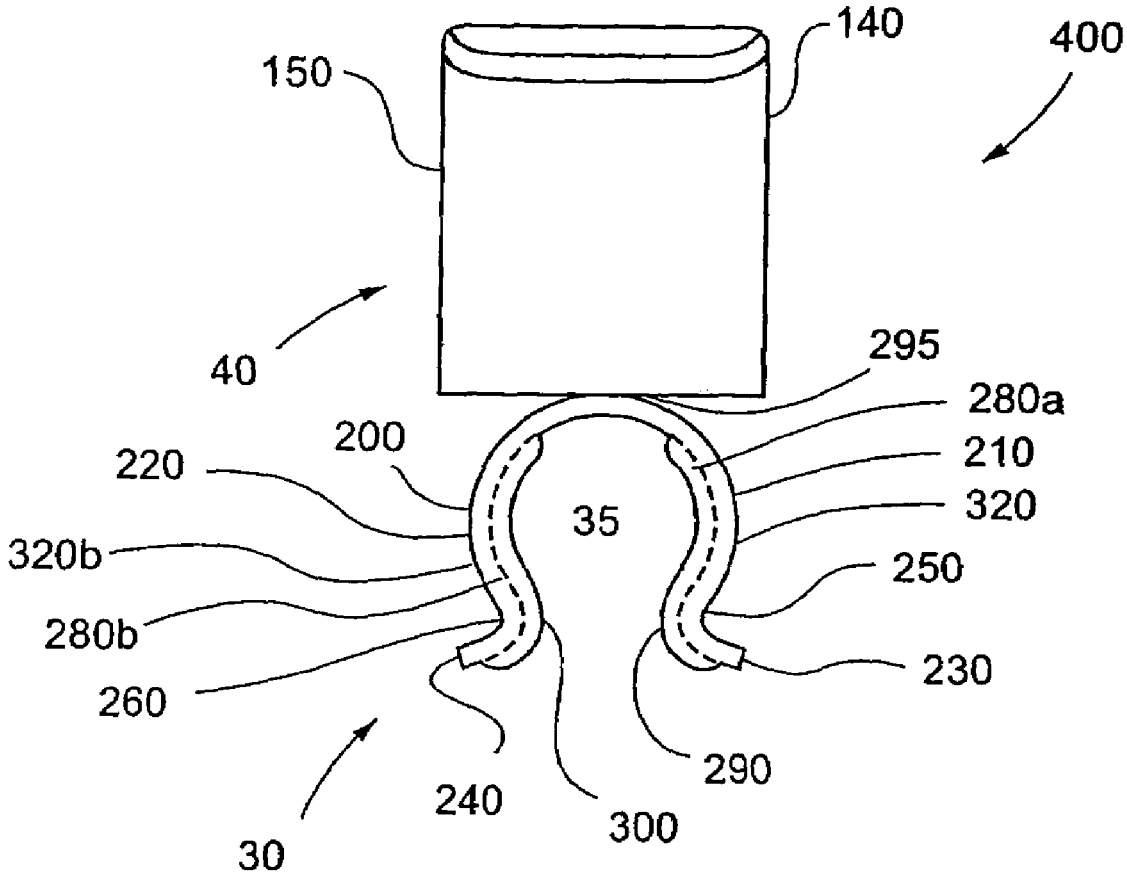
Figure 5A:
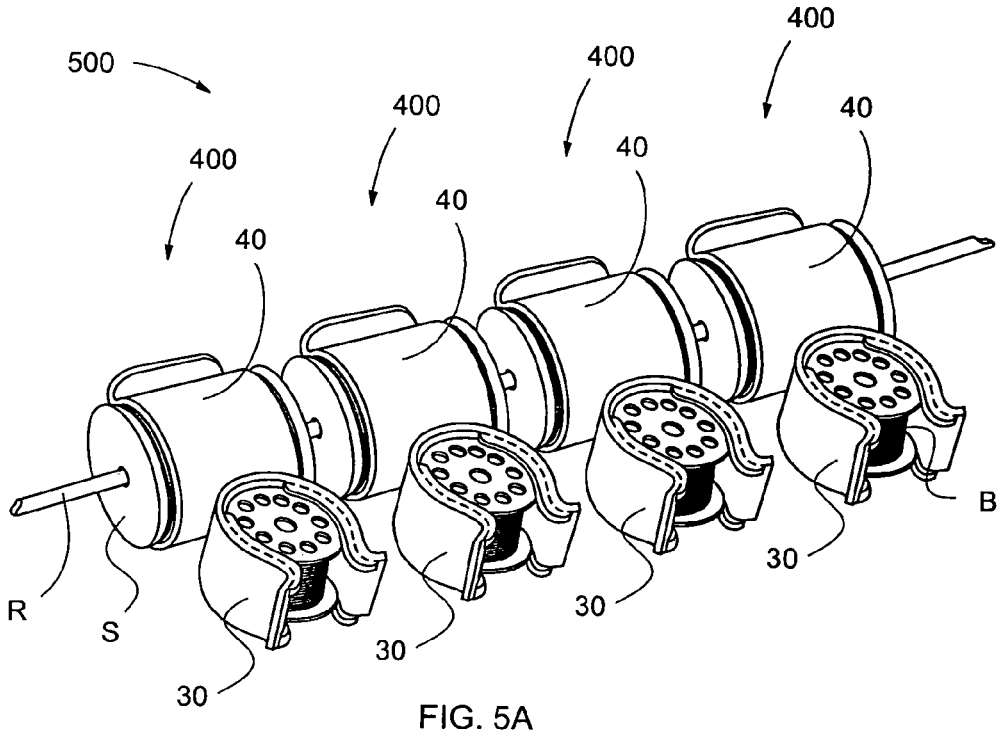
Figure 5B:
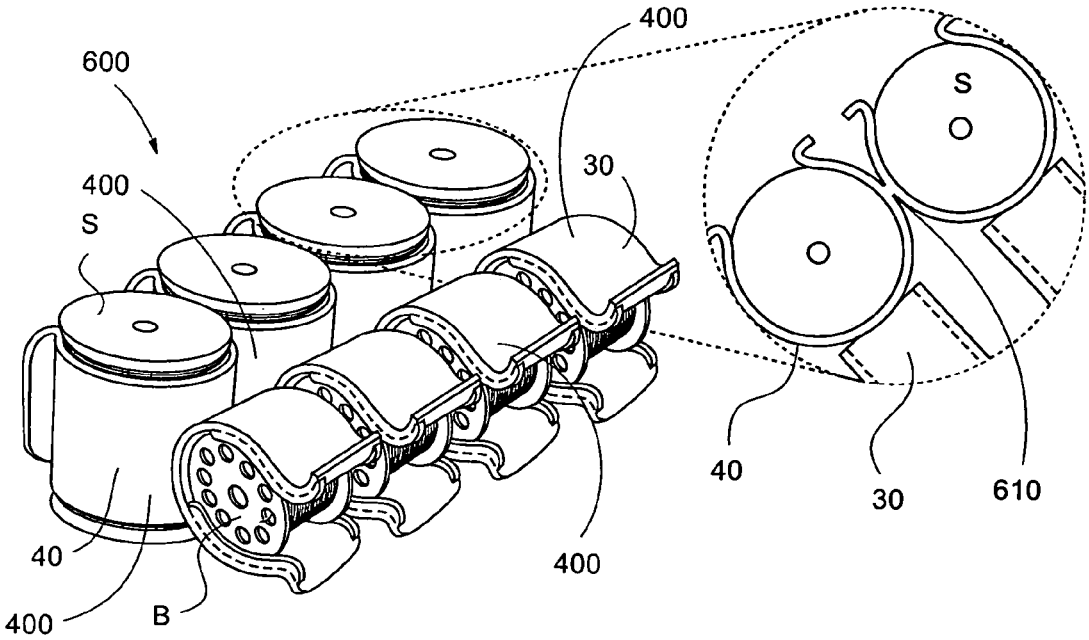
Figure 6A:
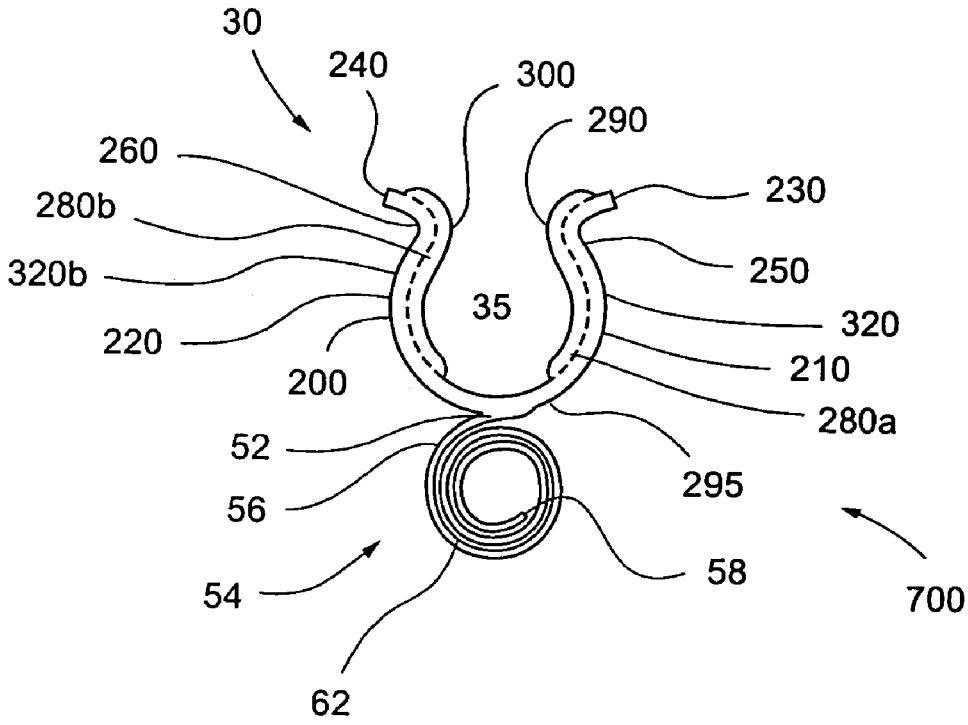
Figure 6B:
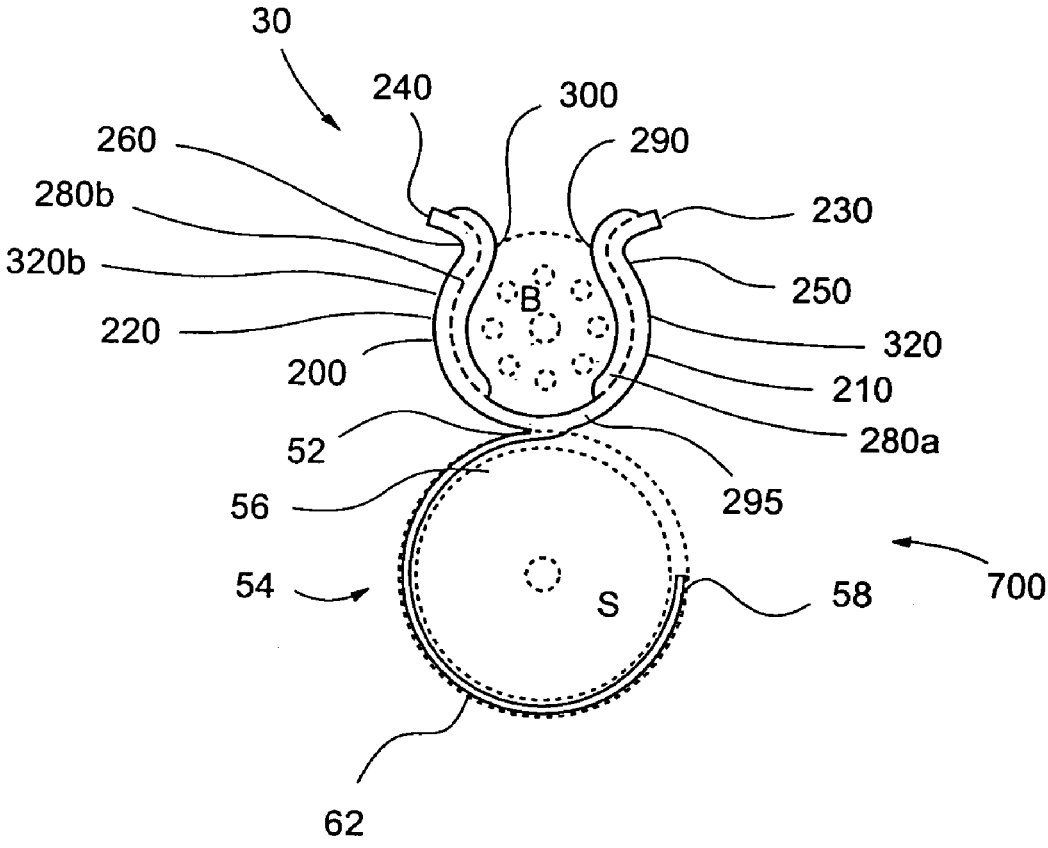
Figure 7:
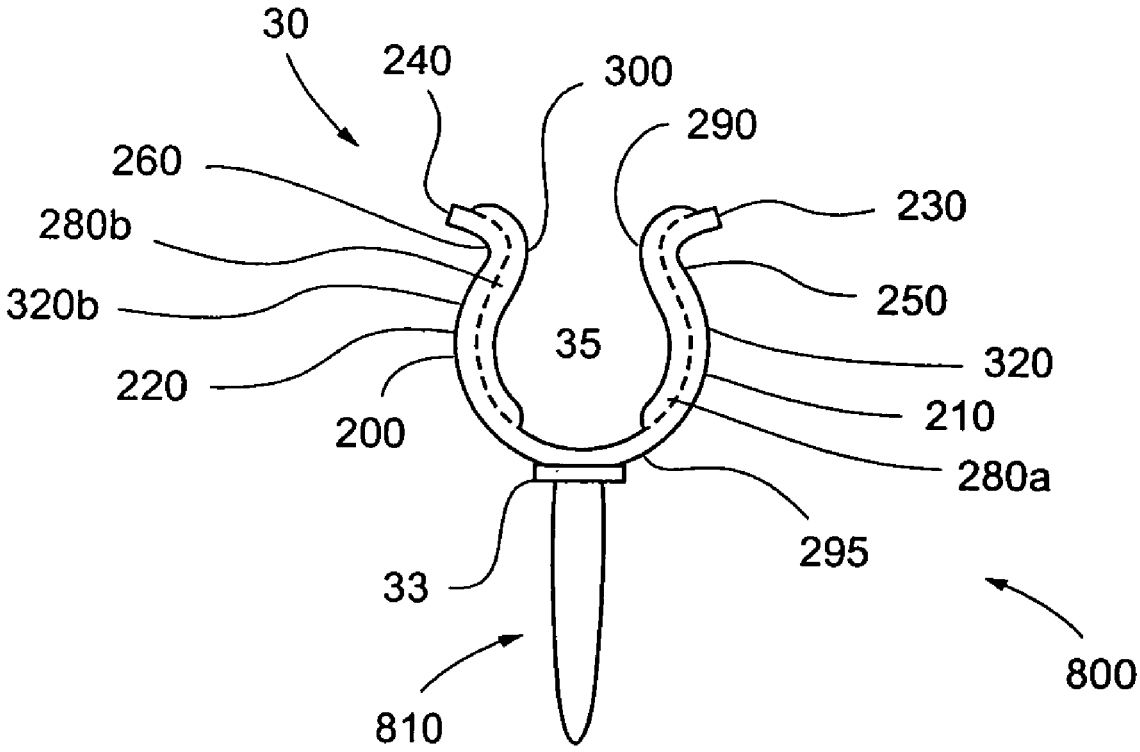

FIG. 2 is a perspective view of a device according to a preferred embodiment of the present invention;

FIG. 3 is a perspective view of a device according to an alternate embodiment of the present invention;

FIG. 4 depicts a plan view of a device according to an alternate embodiment of the present invention;

FIG. 5A is a perspective view of a device according to an alternate embodiment of the present invention;

FIG. 5B is a perspective view of a device according to an alternate embodiment of the present invention;

FIG. 6A is a plan view of a device according to an alternate embodiment of the present invention;

FIG. 6B is a plan view of a device according to the alternate embodiment depicted in FIG. 6A, shown in use; and FIG. 7 depicts a plan view of a device according to an alternate embodiment of the present invention.

Figure 8:
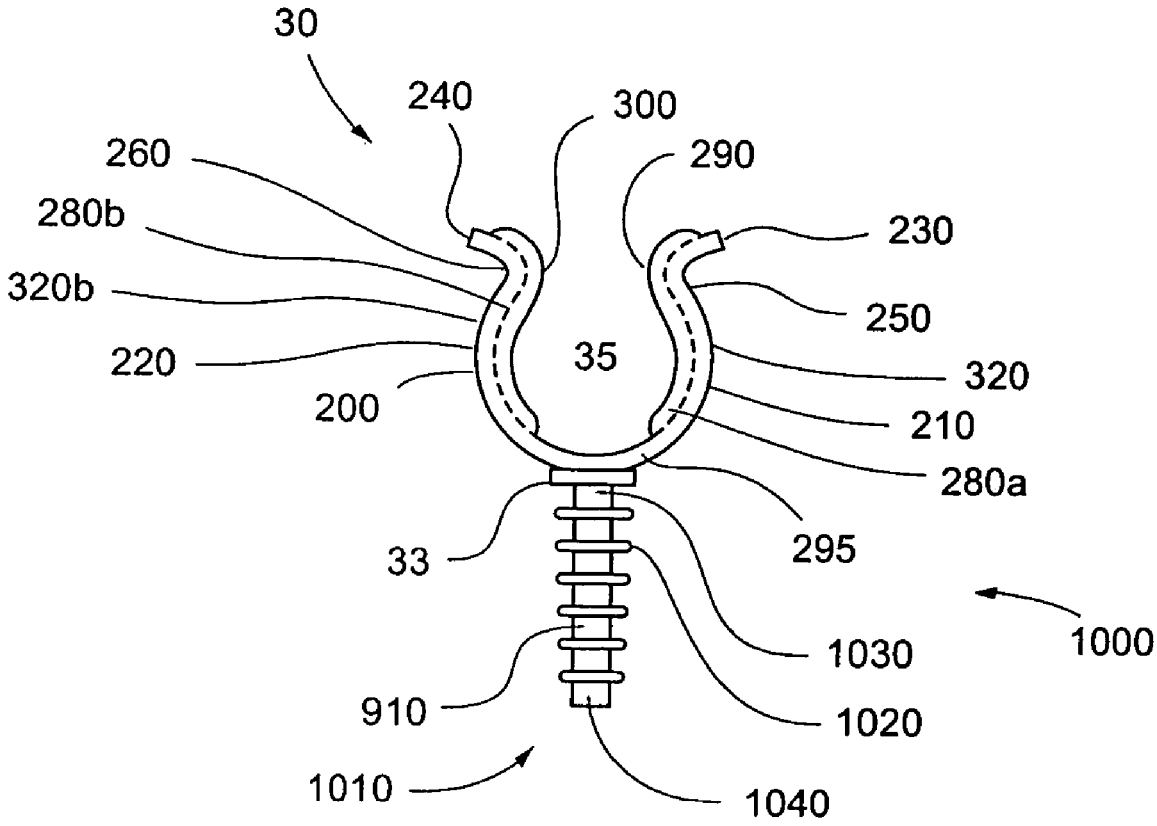

FIG. 8 depicts a plan view of a device according to an alternate embodiment of the present invention.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A, 1B and 2, apparatus 10 is a combination thread spool and bobbin holder preferably having spool retention section 20 carried on bobbin retention section 30. Spool retention section 20 is preferably formed as a generally bow-legged wedge device preferably having first leg 26, second leg 28, base 32, support 33 and tip 34. First end 36 of first leg 26 and first end 38 of second leg 28 are preferably carried by base 32 of spool retention section 20, preferably proximate to rear 295 of bobbin retention section 30, wherein first leg 26, second leg 28 and rear 295 comprise a 'U'-shape, and wherein rear 295 comprises the bottom of said 'U'-shape. Support 33 is preferably cylindrical in form, but it will be recognized by those in the art that other shapes can easily substituted without changing the functionality. Support 33 preferably provides a rest against which spool S can reside when pushed fully onto spool retention section 20. By placing the end of thread T between spool S and support 33, thread T is preferably held firmly, preventing unravelling of spool S.

First leg 26 and second leg 28 preferably join together at second ends 42 and 44, respectively, to form tip 34. The shape of spool retention section 20 is preferably such as to facilitate its insertion into spool S.

For insertion of spool retention section 20 into spool S, tip 34 is preferably positioned in contact with hole H of spool S. Pressure applied to apparatus 10 in longitudinal alignment with hole H of spool S preferably causes spool retention section 20 to firmly enter hole H. Midpoint 23 of first leg 26 and midpoint 25 of second leg 28 are preferably spaced apart a distance greater than the diameter of hole H, which distance is also greater than the distance between first ends 36 and 38 at base 32 and second ends 42 and 44 at tip 34. First leg 26 and second leg 28 are preferably made of a material and in a shape that permits resilient compression of first leg 26 and second leg 28 toward each other when entering hole H, preferably causing first leg 26 and second leg 28 to subsequently recoil against the sides of hole H of spool S with sufficient force to hold spool S securely, preferably with spool retention section 20 inserted full length, and preferably causing base 32 to contact spool S. Contact between base 32 and spool S will preferably hold loose thread end T if wound several turns round the juncture of leg ends 36 and 38 proximate to base 32.

Bobbin retention section 30 is preferably formed as 'U'-shaped device 200 preferably having first side 210 and second side 220. First side 210 preferably has first lip 230 preferably located at first end 250. Second side 220 preferably has second lip 240 preferably located at second end 260. First bend 290 is preferably formed in first side 210 preferably proximal to first end 250. Second bend 300 is preferably formed in second side 220 preferably proximal to second end 260. First side 210 preferably has first edge 310*a* and second edge 320*a* located thereon. Second side 220 preferably has located thereon first edge 310*b* and second edge 320*b*. Preferably defined along first edge 310*a* of first side 210 of bobbin retention section 30 is first ridge 270*a*. Preferably defined along second edge 320*a* of first side 210 of bobbin retention section 30 is second ridge 280*a*. Preferably defined along first edge 310*b* of second side 220 of bobbin retention section 30 is third ridge 270*b*. Preferably defined along second edge 320*b* of second side 220 of bobbin retention section 30 is fourth ridge 280*b*.

For insertion of bobbin B into bobbin retention section 30, bobbin B is preferably positioned in simultaneous contact with first lip 230 at first bend 290 and second lip 240 at second bend 300, preferably in between ridges 270*a* and 280*a* of first side 210 and ridges 270*b* and 280*b* of second side 220, and is pressed toward interior 35 of bobbin retention section 30. Pressure on bobbin B toward interior 35 preferably causes resilient opening of first side 210 and second side 220 relative to each other. The resilient opening of first side 210 relative to second side 220 preferably facilitates the insertion of bobbin B into interior 35 of bobbin retention section 30, wherein bobbin B is preferably positioned proximate rear 295 of bobbin retention section 30. Movement of bobbin B past first bend 290 and second bend 300 into interior 35 preferably causes first side 210 and second side 220 to recoil toward their at-rest position with sufficient force to securely hold bobbin B within interior 35.

Ridges 270*a*, 270*b*, 280*a*, and 280*b* of bobbin retention section 30 preferably confine bobbin B laterally and preferably assist to secure bobbin B within bobbin retention section 30.

Bobbin retention section 30 and spool retention section 20 preferably retain bobbin B and spool S, respectively, wherein spool S and bobbin B are non-coaxial with respect to each other, and wherein bobbin retention section 30 and spool retention section 20 are preferably fixably joined, such as, for exemplary purposes only, having been molded as one piece or assembled with adhesive from their separate sections. Apparatus 10 is preferably formed by injection molding, but it should be recognized by one skilled in the art that other suitable processes might be utilized.

Apparatus 10 is preferably made from a resilient plastic material that is transparent or translucent so that visual identification of the color of the thread on bobbin B and spool S is possible from any angle of view. Alternatively, apparatus 10 may be opaque. However, one skilled in the art would readily understand that any appropriate material could be utilized, such as, for exemplary purposes only, nylon, rubber, wood, and/or metal.

Referring now to FIGS. 3 and 4, in an alternate embodiment, apparatus 400 replaces spool retention section 20 with spool retention section 40. This alternate embodiment is a combination thread spool and bobbin holder having spool retention section 40 fixably attached to bobbin retention section 30, proximate rear 295 of bobbin retention section 30. Spool retention section 40 is formed as generally 'U'-shaped device 50 having first side 60 and second side 70. First side 60 has first lip 80 located at first end 100. Second side 70 has second lip 90 located at second end 110 of spool retention section 40. First bend 120 is formed in first side 60 proximal to first end 100. Second bend 130 is formed in second side 70 proximal to second end 110. First side 60 and second side 70 have common first edge 140 and common second edge 150. The dimension between first edge 140 and second edge 150 is preferably less than the length of spool S to be received within spool retention section 40.

For insertion of spool S into spool retention section 40, spool S is positioned in simultaneous contact with first lip 80 at first bend 120 and with second lip 90 at second bend 130. Pressure applied to spool S toward interior 45 of spool retention section 40 causes resilient opening of first side 60 and second side 70 relative to each other. The resilient opening of first side 60 relative to second side 70 facilitates the insertion of spool S into interior 45 of spool retention section 40, such that spool S is positioned proximate rear 125 of spool retention section 40. Movement of spool S past first bend 120 and second bend 130 into interior 45 causes first side 60 and second side 70 to recoil toward their at-rest position with sufficient force to securely hold spool S within interior 45.

When spool S is positioned within spool retention section 40, spool edges E' and E" remain outside first edge 140 and second edge 150 of spool retention section 40. The diameter of spool edges E' and E" is greater than the diameter defined by first edge 140 and second edge 150, thereby inhibiting lateral movement of spool S and assisting in the containment of spool S within spool retention section 40.

Bobbin retention section 30 is formed as 'U'-shaped device 200 having first side 210 and second side 220. First side 210 has first lip 230 located at first end 250. Second side 220 has second lip 240 located at second end 260. First bend 290 is formed in first side 210 proximate first end 250. Second bend 300 is formed in second side 220 proximate second end 260. First side 210 has first edge 310*a* and second edge 320*a* located thereon. Second side 220 has located thereon first edge 310*b* and second edge 320*b*. Defined along first edge 310*a* of first side 210 of bobbin retention section 30 is first ridge 270*a*. Defined along second edge 320*a* of first side 210 of bobbin retention section 30 is second ridge 280*a*. Defined along first edge 310*b* of second side 220 of bobbin retention section 30 is third ridge 270*b*. Defined along second edge 320*b* of second side 220 of bobbin retention section 30 is fourth ridge 280*b*.

For insertion of bobbin B into bobbin retention section 30, bobbin B is positioned in simultaneous contact with first lip 230 at first bend 290 and second lip 240 at second bend 300, in between ridges 270*a* and 280*a* of first side 210 and ridges 270*b* and 280*b* of second side 220, and is pressed toward interior 35 of bobbin retention section 30. Pressure on bobbin B toward interior 35 causes resilient opening of first side 210 and second side 220 relative to each other. Resilient opening of first side 210 relative to second side 220 facilitates the insertion of bobbin B into interior 35 of bobbin retention section 30, wherein bobbin B is positioned proximate rear 295 of bobbin retention section 30. Movement of bobbin B past first bend 290 and second bend 300 into interior 35 causes first side 210 and second side 220 to recoil toward their at-rest position with sufficient force to securely hold bobbin B within interior 35. Ridges 270*a*, 270*b*, 280*a*, and 280*b* of bobbin retention section 30 confine bobbin B laterally and assist to secure bobbin B within bobbin retention section 30.

Bobbin retention section 30 is ninety degrees relative to the plane of spool retention section 40 so that first side 210 and second side 220 of bobbin retention section 30 are positioned ninety degrees relative to the plane in which first side 60 and second side 70 of spool retention section 40 are located.

Bobbin retention section 30 and spool retention section 40 are rigidly joined, such as, for exemplary purposes only, having been molded as one piece or their separate sections assembled with adhesive or rivet at the general midpoint of their respective 'U'-shapes proximate to rear 125 of spool retention section 40 and rear 295 of bobbin retention section 30. Apparatus 10 is formed by injection molding, but it should be recognized by one skilled in the art that other suitable processes might be utilized.

It is further contemplated in an alternate embodiment that spool retention section 40 and bobbin retention section 30 may lie in a common plane such that first side 60 and second side 70 of spool retention section 40 lie in the same plane as first side 210 and second side 220 of bobbin retention section 30.

Apparatus 10 is made from a resilient plastic material that is transparent or translucent so that visual identification of the color of the thread on bobbin B and spool S is possible from any angle of view. Alternatively, apparatus 10 may be opaque. However, one skilled in the art would readily understand that any appropriate material could be utilized, such as, for exemplary purposes only, nylon, rubber, wood and/or metal.

It is contemplated that a plural number of apparatus 400 units could be grouped into device 500 as shown in FIG. 5A, wherein a plurality of apparatus 400 units are strung upon rod R, utilizing the center hole in each spool S. Alternatively, a plurality of individual apparatus 400 units could be strung upon rod R utilizing the center hole of each bobbin B.

Another embodiment shown in FIG. 5B is device 600, a series of individual apparatus 400 units, wherein the several apparatus 400 units are attached at the sides of spool retention sections at 610, forming a new composite device having multiple spool retention sections 40 and multiple of bobbin retention sections 30.

An additional embodiment is depicted in FIGS. 6A and 6B. Device 700 comprises bobbin retention section 30 as set forth in detail above. Spool retention section 20 of the preferred embodiment is replaced by spool retention section 54, wherein spool retention section 54 defines a coil having first end 56, second end 58 and body 62. Spool retention section 54 is fixably attached to bobbin retention section 30 at joint 52, where first end 56 is proximate rear 295 of bobbin retention section 30.

Body 62 of coil 54 has a natural tendency to remain compactly wound closed prior to use, as shown in FIG. 6A. Coil 54 may be opened by forcibly unwinding coil 54, permitting placement of coil 54 around spool S. The tendency of coil 54 to rewind compactly closed causes a firm hold on spool S within body 62, as shown in FIG. 6B.

In another alternate embodiment, spool retention section 20 could be a solid rod of a graduated diameter suitable to afford a frictional fit within hole H of spool S.

Shown alternatively in FIG. 7, device 800 replaces spool retention section 20 of the preferred embodiment with prong section 810 of graduated width, with its widest portion adjacent to base 33 on which it is carried and which is proximate rear 295 of bobbin retention section 30. Prong section 810 is slightly wider than the diameter of hole H in spool S. When inserted in spool S, prong section 810 frictionally retains spool S thereon.

Shown alternately in FIG. 8, in device 1000, spool retention section 20 of the preferred embodiment is replaced with multi-disc section 1010 carried by base 33 which is proximate rear 295 of bobbin retention section 30. Discs 1020 are carried by rod 910, wherein discs 1020 extend from first end 1030 of rod 910 to second end 1040 of rod 910, and wherein disc of largest diameter is located proximate first end 1030 and disc of smallest diameter is located proximate second end 1040, and wherein discs comprise a set each having a decreasing diameter. When inserted into spool S, discs 1020 deform sufficiently to frictionally retain spool S thereon.

The foregoing description and drawings comprise illustrative preferred and alternate embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing the steps of the method in a certain order does not necessarily constitute any limitation on the order of the steps of the method. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. A combination spool and bobbin holder comprising:

at least one spool receiving member; and at least one bobbin receiving member, wherein said at least one bobbin receiving member is carried proximate to said at least one spool retaining member, and wherein said at least one bobbin receiving member and said at least one spool receiving member are positioned to retain a bobbin and a spool in a non-coaxial association relative to one another such that the winding axis of the retained bobbin is perpendicular to the winding axis of the retained spool.

2. The holder of claim 1, wherein said spool receiving member is comprised of resilient material.

3. The holder of claim 2, wherein said resilient material is selected from the group consisting of plastic, rubber, metal, nylon and wood.

4. The holder of claim 1, wherein said bobbin receiving member is comprised of resilient material.

5. The holder of claim 4, wherein said resilient material is selected from the group consisting of plastic, rubber, metal, nylon and wood.

6. The holder of claim 3, wherein said resilient material is translucent.

7. The holder of claim 5, wherein said resilient material is translucent.

8. The holder of claim 3, wherein said resilient material is transparent.

9. The holder of claim 5, wherein said resilient material is transparent.

10. The holder of claim 1, wherein said at least one spool receiving member is selected from the group consisting of at least one generally 'U'-shaped member, at least one generally pin-shaped member and at least one generally coil-shaped member.

11. The holder of claim 10, wherein said generally pin-shaped member comprises a prong-shaped member.

12. The holder of claim 10, wherein said generally pin-shaped member comprises a pin and disc member.

13. The holder of claim 10, wherein said at least one generally 'U'-shaped spool receiving member has two side edges and two ends, and wherein each of said two ends defines a generally arcuate peripheral edge.

14. The holder of claim 13, wherein said two side edges of said at least one generally 'U'-shaped spool receiving member define a spool receiving area having a dimension less than the length of the spool to be received therein.

15. The holder of claim 10, wherein said at least one generally pin-shaped member comprises at least one solid rod, wherein said at least one solid rod is capable of retaining the spool in a frictional fit.

16. The holder of claim 10, wherein said at least one generally pin-shaped member comprises at least one solid rod having a longitudinal axis, wherein said at least one solid rod further comprises at least one disc thereon in a plane normal to said longitudinal axis of said solid rod, and wherein said at least one solid rod and said at least one disc frictionally retain the spool.

17. The holder of claim 1, wherein said at least one spool receiving member comprises:

a base; and a pin-shaped member, wherein the spool is held frictionally by said pin-shaped member proximate said base, whereby thread from the spool is securable between said base and the spool.

18. The holder of claim 1, wherein said at least one spool receiving member comprises:

a spirally-wound spring member, wherein said spring member can be extended around the spool, and wherein the spring member and its tendency to return to a wound state retains the spool.

19. The holder of claim 1, wherein said at least one bobbin receiving member is generally 'U'-shaped and has two peripheral ends.

20. The holder of claim 19, wherein each of said two peripheral ends of said at least one generally 'U'-shaped bobbin receiving member defines a generally arcuate edge.

21. The holder of claim 19, wherein said at least one generally 'U'-shaped bobbin receiving member has an interior surface, and wherein at least one bobbin retention ridge is carried by said interior surface.

22. The holder of claim 19, further comprising means for inhibiting lateral movement of the bobbin.

23. The holder of claim 21, comprising at least two bobbin retention ridges, wherein said at least two bobbin retention ridges are positioned to receive the bobbin therebetween.

24. The holder of claim 1, wherein said spool receiving member and said bobbin receiving member are positioned in planes rotated by ninety degrees relative to one another.

25. The holder of claim 1, wherein said spool receiving member and said bobbin receiving member are integrally molded.

* * * * *